US005900027A

United States Patent [19]

Geihsler et al.

[11] Patent Number: 5,900,027

[45] Date of Patent: May 4, 1999

[54] PROCESS FOR PREPARING ANIMAL HIDES OR PELTS

[76] Inventors: Helmut Geihsler, Neue Sandkaul 4, 50859 Köln; Eckhard Weidner, Am Dorfweiher 9, 91056 Erlangen, both of Germany

[21] Appl. No.: 08/894,962

[22] PCT Filed: Mar. 1, 1996

[86] PCT No.: PCT/EP96/00882

§ 371 Date: Nov. 19, 1997

§ 102(e) Date: Nov. 19, 1997

[87] PCT Pub. No.: WO96/27682

PCT Pub. Date: Sep. 12, 1996

[30] Foreign Application Priority Data

Mar. 3, 1995 [DE] Germany ..... 195 07 572

[51] Int. Cl.[6] ..... C14C 1/04; C14C 3/00; C14C 9/02

[52] U.S. Cl. ..... 8/94.19 R; 8/94.15; 8/94.18; 8/94.33; 8/94.2; 8/94.21; 8/94.24; 8/94.25; 8/94.27; 8/94.32

[58] Field of Search ..... 8/94.15, 94.18, 8/94.19 R, 94.33, 94.2, 94.21, 94.24, 94.25, 94.27, 94.32

[56] References Cited

U.S. PATENT DOCUMENTS

| | | | |
|---|---|---|---|
| 5,326,377 | 7/1994 | Tuohimaa et al. | 8/94.18 |
| 5,512,058 | 4/1996 | Gavend et al. | 8/94.18 |

FOREIGN PATENT DOCUMENTS

| | | |
|---|---|---|
| 0439108 | 7/1991 | European Pat. Off. . |
| 624654 | 11/1994 | European Pat. Off. . |
| 0624654 | 11/1994 | European Pat. Off. . |
| 4116872 | 11/1992 | Germany . |
| 9408054 | 4/1994 | WIPO . |

OTHER PUBLICATIONS

Sharphouse, The Leatherworker's Handbook, pp. 37–42 (month unknown), 1963.

*Primary Examiner*—Alan Diamond
*Attorney, Agent, or Firm*—Webb Ziesenheim Bruening Logsdon Orkin & Hanson, P.C.

[57] ABSTRACT

In order to make processes for finishing animal hides or pelts less labor-intensive and more environmentally compatible, a process is proposed in which, following a conventionally conducted soak, the animal hides or pelts are treated with a conventional tanning solution in which carbon dioxide has been dissolved under pressure. This makes it possible to reduce considerably the period of time usually required for the production of leather or pelts, since the treatment period is reduced markedly. Furthermore, it is possible in this way to combine conventional treatment steps and to conduct them in only one single treatment step. Instead of the 20 to 40 t of waste water per tonne of leather or pelt which are customary with conventional processes, only about 2 t of waste water per tonne of leather or pelt are now produced. Besides having a sharply reduced environmental impact, the proposed process is also significantly more economical than conventional processes, owing to the considerably shorter overall processing time.

19 Claims, 2 Drawing Sheets

PROCESS FOR PREPARING ANIMAL HIDES OR PELTS

BACKGROUND OF THE INVENTION

This application is a 371 of PCT/EP96/00882 filed Mar. 1, 1996.

The invention relates to a process for finishing animal hides or pelts. Animal hides and pelts are required in many areas of daily life and also for industrial applications. Examples are the clothing industry, medical articles, furniture industry, automotive accessories and cleaning materials. The processing of pelts and hides is a significant economic factor in industrialized countries and in agrarian countries.

The hides or pelts have to be finished in accordance with the various end uses. The principal aims of finishing are to establish durability and to generate the desired morphological (e.g. handle, tear strength, suppleness, water resistance) and color properties.

The text below describes by way of example the customary processing and finishing of pelts or skins, which corresponds in large areas with the processing and finishing of leathers and hides. The main function of the various pelt or hide treatment steps is to reach a state of swelling of the skin pores and of the hairs, in which state penetration of tanning chemicals and thus the crosslinking and strengthening of the collagen chains is possible. Unlike the preparation of leather, where an unhairing step is required, pelt processing requires unconditionally that the coat of hair is maintained. To aid comprehension, the individual steps of conventional pelt or skin finishing, which are detailed below, are reproduced in FIGS. 1 and 2 the form of a flow diagram.

The pelts removed are usually not processed fresh but are preserved by drying, salting or deep-freezing. The first processing step in the finishing of skins, therefore, is a soak, by means of which the pelts are prepared for subsequent treatment. The soak is usually conducted with cold water to which a certain amount of surfactants have been added. The soaking period is from 8 to 24 hours. The mass ratio between the solution, in this case the soak solution, and the pelts, which is referred to below as the liquor ratio, is between 6–12:1. After the end of the soak, the liquid discharged from the soak tub together with the pelts is removed by centrifuging and obtained together with the remaining soak solution as waste water. The pelts are sorted and subjected to various mechanical processing steps (turning, cutting, drawing). In the next process step the pelts are washed. This usually takes place with a warmed (25–35° C.) water/surfactant solution to which small amounts of salt have been added. The added salt and the elevated temperature produce slight swelling of the pores and of the keratin structure of the hair. The soaking period and the liquor ratio are identical to those for the soak. After the end of the wash, the pelts are again centrifuged and mechanically processed. The wash solution is obtained as waste water.

In a further bath, the pelts are "opened up". For this purpose, the pelts are treated in an aqueous solution the pH of which has been set to 3.8 to 4. For this purpose, in most cases organic acids are employed. To avoid hairslip, the so-called "pickling solution" used for opening up must have relatively large amounts of salt added to it in order to attenuate the effect of the acid. The aim of opening up is to widen the pores and the hair structure for subsequent tanning in order to enable the tanning solution to penetrate. Here too, the liquor ratios are from 6 to 12:1. The soaking periods are usually substantially longer than in the case of the preceding baths and are in the range from 12 to 48 hours. In the case of the preparation of leather, the hides are unhaired at this point, which is achieved by altering the pH and the salt concentration in contrast to the dressing of skins. The opening-up solution or, respectively, the unhairing solution is obtained as waste water and must if appropriate be filtered and neutralized before being introduced into the waste-water system.

In the next processing step, tanning, the pelts are treated with a buffered solution of tanning chemicals in water. As a result of tanning, the peptide chains of the collagen are crosslinked, strengthened and isolated from one another. In this context, a very wide variety of tanning agents can be employed. Plant-based tanning agents, synthetic organic tanning agents and inorganic tanning agents are known. In the pelt industry use is frequently made, owing to their comparatively weak tanning action, of aluminum salts (e.g. potassium aluminum alum * $10H_2O$) as tanning agents, whereas in the preparation of leather it is common to use chromium(III) salts, aromatic syntans, enzymes or vegetable tanning agents or tanning-agent extracts, alone or in mixtures. In the case of pelt processing the tanning solutions are set to a pH of from 3.8 to 4. In order to avoid acid swelling of the hides and hairslip, salt is added to the tanning solutions. Tanning usually takes place in tanning drums which rotate about the longitudinal axis. However, dip-tanning or brush-tanning is also carried out. The tanning periods are from 24 to 48 hours, while the liquor ratios are from 6 to 12:1.

In addition to the actual aims of tanning, namely to prepare for dyeing and to obtain water resistance and durability, attempts are also made in the tanning process to obtain additional properties of leather or skins. Thus, certain color effects can be obtained even in the course of tanning. Furthermore, the processed pelts are often fatliquored in the tanning bath in order to obtain a particularly supple pelt with a good handle. For this purpose, so-called leather oils or fats are added to the tanning solution. These substances are usually obtained from fats of land or marine animals or else from vegetable sources. Since these fats and oils are usually insoluble in water, emulsifiers are added to the tanning solutions. However, problems frequently occur because the fat uptake cannot be regulated with any great precision and because not all fats (e.g. drumming fats, see below) can be emulsified in sufficient quantity in the tanning solution.

In a similar way as with the preceding baths, a considerable amount of waste water is obtained in the case of tanning as well. Especially when chromium salts, synthetic organic tanning agents and tanning agents of plant origin are used, the waste water is polluted with ecologically objectionable and/or poorly degradable substances.

Where leathers rather than pelts are being dressed, the finishing process is over at this point except for any dyeing and relatively small post-processing steps which may be carried out. The individual steps which are now described, therefore, essentially apply only to the finishing of pelts or skins.

Tanning is followed by mechanical and thermal processing steps (centrifuging, drying, cutting, drawing). Pelts in particular are subsequently cleaned by means of sawdusting, by treating them with sawdust in so-called clearing drums. In the course of sawdusting, excess fatliquor is adsorbed and the hairs are raised in order to give the pelt more volume.

In the processing of pelts, owing to the above-mentioned problems with the fatliquors or leather oils, a subsequent fatliquoring operation, so-called drum greasing, is required. In this operation, drumming grease is drummed or milled into the pelts in wooden drums with the aid of wooden hammer mechanisms. Relative to the weight of pelt introduced, about 20% drumming grease is added which is incorporated over the course of 30 to 120 minutes. Greasing is followed first by a further cleaning step with sawdust. Here, a small amount of the excess fat is adsorbed. The majority of the excess drumming grease is removed in a subsequent degreasing bath. Here, the pelts are removed in a washing machine either with chlorinated hydrocarbons (nonflammable) or, in the case of appropriate statutory provisions, with substitutes. In this context there has been use in recent times in particular of petroleum fractions, e.g. high-boiling distillates ($T_{b.p.}$=180–190° C., flammable). The wash liquids are distilled and cleaned atmospherically (CHC) or under vacuum (high boilers). The bottom residue (hide residues, hair, long-chain fats, sometimes water, albumen etc.) must be disposed of as special waste.

After degreasing, the pelts are spun and dried and may be subjected to mechanical post-processing. After a further sawdusting process to deodorize the pelts and to produce a more bulky appearance, a final check is carried out in the course of which the pelts are mechanically processed once more and possibly ground (buffed).

With the process described above, furs or leathers are obtained which can be used without further aftertreatment. In many cases, however, colored products are desired. The process steps required for dyeing are not dealt with here since they are not relevant in connection with the present invention.

As is readily evident from the above description of the conventional dressing of skins, the process is highly labor intensive, and even nowadays is still carried out largely by hand. Including the intermediate steps, some of which have not been described in detail, complete skin finishing requires up to 70 operations, in which the hides or pelts are treated with in some cases considerable amounts of chemicals. Since these chemicals are almost always used in dilute aqueous solutions, considerable amounts of waste water are obtained in the finishing of leather or skins. It is nowadays common to have from about 20 to 40 t of waste water per tonne of finished pelt. About ¾ of this amount is waste water with a comparatively low level of pollution, which comprises essentially salt, surfactants and, in small amounts, organic biodegradable acids or inorganic acids. About ¼ of the amount of the waste water, however, includes metal cations and/or organic tanning agents. At best the cations involved here are aluminum or iron cations. Chromium salts are frequently used, especially in the preparation of leather. The organic tanning agents usually are compounds which contain a large number of fused aromatic rings and are therefore of poor biodegradability.

In addition, from 200 to 300 kg of degreasing agent are required per tonne of pelt. These agents are halogenated hydrocarbons or petroleum fractions. The degreasing agents can be recovered by means of distillation. In this case the bottom product obtained is a sludge which has to be disposed of as special waste and which comprises, in addition to residues of the degreasing agent, also fats, albumens and solid particles. From about 100 to 300 kg of the sludge for disposal are obtained per tonne of pelt.

Further consumables are sawdust or cornflour, which are employed in the various cleaning steps. From about 1500 to 2000 kg of sawdust or flour are obtained per tonne of pelt, about 75% of which has to be disposed of as special waste owing to pollution with tanning agents, solvent residues and salts in the case of corresponding statutory regulations.

The situation depicted (manual labor-intensive and thus expensive production, considerable environmental pollution, expensive disposal) has led to a sharp drop in the processing of leather and skins in the industrialized countries for some years.

WO 94/08054 discloses a process for treating tanned or untanned leather in which the leather is brought into contact with a dense pressurized fluid, preferably supercritical or liquid $CO_2$, in order to remove fat from the leather or to impregnate the leather with certain substances. The process employs exclusively the dense fluid as solvent, and the pressure established during the treatment is always above the critical pressure of the fluid that is used.

U.S. Pat. No. 5,326,377 discloses a process for treating hides in which the hides are first of all delimed, then soaked and subsequently washed one or more times in a washing drum with a slightly acidic washing solution which comprises carbon dioxide. The carbon dioxide is fed into the washing drum, which is not under pressure, either by adding it directly to the liquid in the washing drum or supplying it above the level of the liquid, the carbon dioxide flowing continually through the washing drum in a certain quantity during the treatment of hides. After the washing operation described, the hides are tanned.

EP 0 624 654 A2 discloses a process for preparing leather from animal hides, in which the leather is delimed in an aqueous solution with the aid of $CO_2$ under gentle pressure.

EP 0 439 108 A1 discloses a leather treatment process which employs $CO_2$ as deliming agent. In order to shorten the treatment period required for a deliming, this document proposes that the stream of carbon dioxide which is passed through the treatment vessel is raised at least once during the period of treatment.

The object of the invention is to indicate a process for finishing animal hides or pelts which is less labor-intensive and which permits considerably more rapid dressing of hides or pelts together with a significantly reduced use of chemicals, thereby reducing at the same time the environmental pollution.

SUMMARY OF THE INVENTION

This object is achieved in accordance with the invention by a process for finishing animal hides or pelts in which the animal hides or pelts, following a conventionally conducted soak, are treated with a conventional tanning solution in which carbon dioxide has been dissolved under pressure. In this way, by means of the process according to the invention, various of the conventional baths and/or treatment steps can be combined into a single treatment step, thereby significantly reducing the overall processing time required for preparing the pelt or leather.

The above-mentioned drastic reduction in treatment times is attributed to the fact that the penetration and the resorption or the reaction of the bath chemicals (surfactants, salts, fats, tanning chemicals) in the skin structure is considerably accelerated by the presence of carbon dioxide. However, this accelerating effect is only achieved if the hides or pelts to be treated are at least wet. In accordance with the invention, therefore, it is sufficient if the pelts or hides to be treated are just dipped into the corresponding treatment solution and then subsequently placed in a pressure vessel in which they are subjected to carbon dioxide pressure. Alternatively, it is possible for the pelts or hides that are to be treated to be left immersed in the corresponding treatment solution and to subject the vessel containing the hides or pelts and the treatment solution to carbon dioxide pressure. In this case, the vessel can be filled completely with the treatment solution or there may be a carbon dioxide atmosphere over the aqueous treatment solution. All that is essential for the process according to the invention is that carbon dioxide has been dissolved under pressure in the respective aqueous treatment solution. This treatment solution can be a conventional soak solution, tanning solution or a combination of the abovementioned solutions. Conventional soak solutions comprise a mixture of anionic, cationic or nonionic surfactants and salt, especially rock salt or common salt. Conventional tanning solutions comprise a mixture of vegetable tanning agents or tanning extracts (wattle), organic tanning agents, inorganic tanning agents, anionic, cationic or nonionic surfactants, leather oils and fatliquors based on plant or animal substances, organic or inorganic acids and salt, especially rock salt or common salt.

DESCRIPTION OF THE PREFERRED EMBODIMENTS

Figure 1:
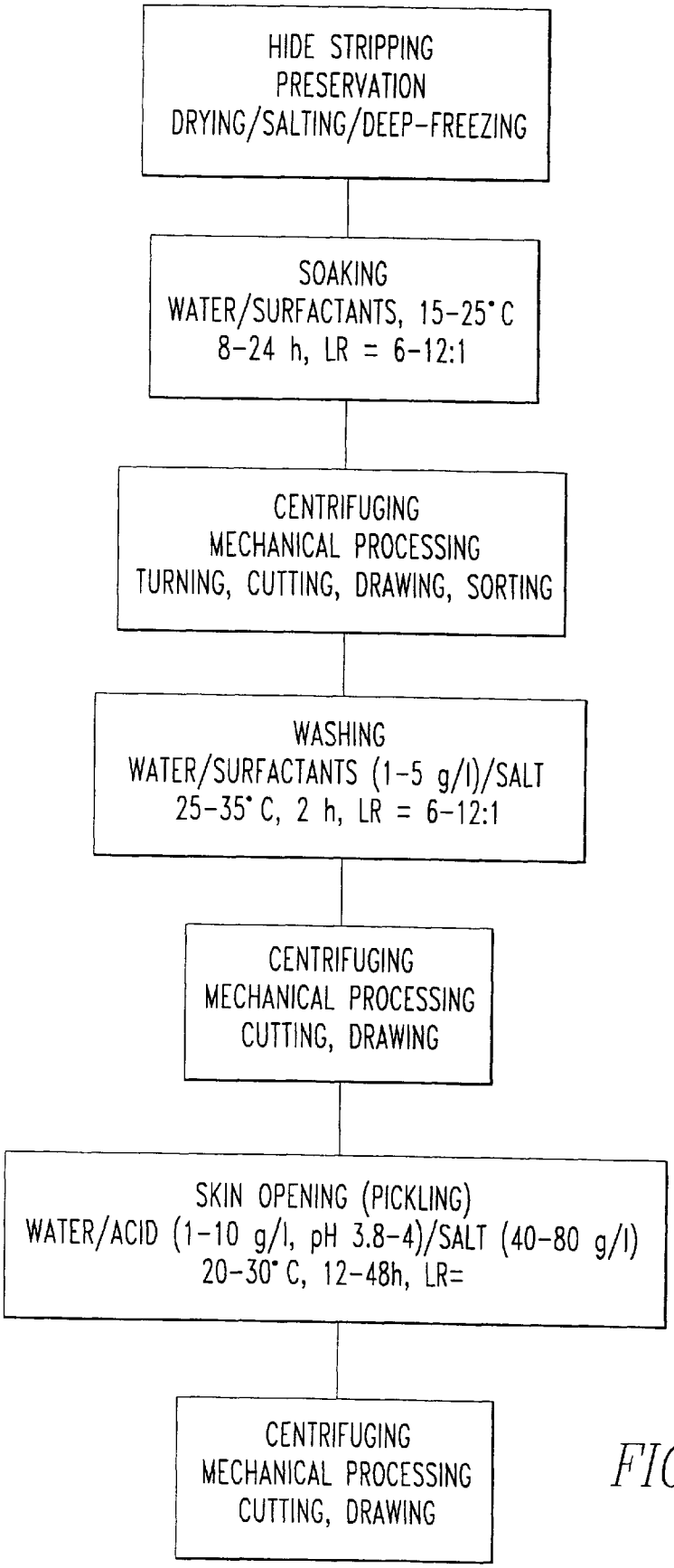
FIGS. 1 and 2 show a flow diagram of the steps in conventional pelt or skin finishing.
Figure 2:
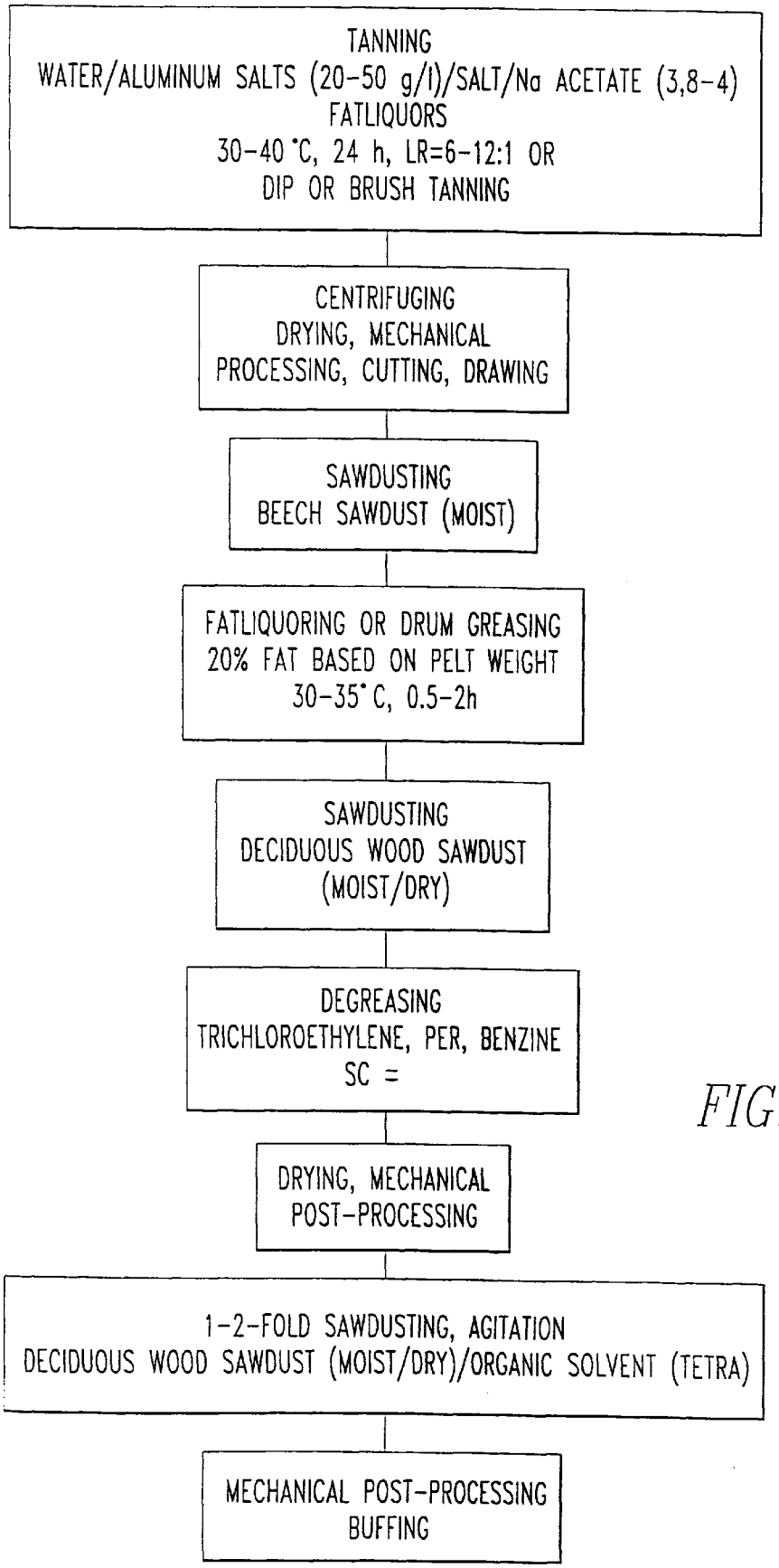

According to one embodiment of the process according to the invention, soaked pelts are placed in the autoclave. Washing and opening up are unnecessary. Tanning solution is introduced until the pelts are covered. Then carbon dioxide is introduced up to a pressure of between 5 and 300 bar, preferably from 10 to 200 bar and, with particular preference, from 15 to 50 bar. At a temperature between 20 and 50° C., preferably from 25 to 45° C., the pelts or hides are tanned for from 30 to 300 minutes, preferably from 45 to 180 minutes. After the autoclave has been let down the pelts or hides are removed and are processed further in conventional manner or as described below. The qualities obtained with this procedure correspond to those of conventional processing.

A modification of the above-described exemplary embodiment is to treat soaked and washed pelts or hides in tanning solution under a carbon dioxide atmosphere. For this purpose the pelts are soaked with soak solution (cold water, surfactants, a little salt) and after the customary mechanical intermediate steps are washed (warm water, surfactants, higher salt concentration). The pelts thus pretreated are placed in an autoclave. They can be introduced in a disordered form. In this case, a roller autoclave must be employed for complete tanning. Alternatively, they can be introduced on appropriate suspension devices. In this case, fixed autoclaves can be employed. The autoclaves are charged with sufficient tanning solution to just cover the pelts or hides. After the introduction of carbon dioxide with a pressure of between 5 and 300 bar, preferably from 10 to 200 bar and, in particular, from 15 to 50 bar, the pelts or hides are treated at a temperature between 20 and 50° C., preferably from 25 to 45° C., for from 30 to 300 minutes, preferably from 45 to 180 minutes. Use is made of customary tanning solutions whose principal ingredients, depending on the intended application, are metal salts, tanning agents, tanning extracts, enzymes, acids, buffers, salt, leather oil/fatliquor/fat, surfactants/emulsifiers. Intensive contact between the tanning solution and the material to be tanned can be brought about by revolving the gas phase and/or liquid phase by means of installed stirring elements or by means of external circulation-promoting elements. After the end of the treatment period, the contents of the autoclave are let down and the carbon dioxide may, if appropriate, be recovered in whole or in part. The pelts or hides are subsequently subjected to further conventional processing (mechanical processing, drum greasing, degreasing, cleaning [sawdusting]).

To supplement this, in accordance with a further exemplary embodiment of the process according to the invention, the greasing of the pelts can be integrated into the tanning process. This is done by using a special fat formulation which is emulsified in aqueous phase with appropriate surfactants and whose penetration into the hide structure is accelerated by carbon dioxide. In this case it is necessary to increase the treatment times to about 3 to 20 hours, preferably from 4 to 12 hours. The pressures and temperatures are within the above-mentioned range (see previous paragraph). In this exemplary embodiment, only a milling or drumming process (without the addition of fat) and also cleaning steps and mechanical operations are required for the subsequent further treatment of the pelts or hides. Degreasing and the associated use of hydrocarbons, halogenated hydrocarbons or other fat-dissolving agents can be omitted.

Another possibility for the integrated greasing of the pelts or hides is, following the tanning carried out under the action of carbon dioxide, first to dry the pelts or hides and then to grease them with the aid of carbon dioxide. In this case the preferred apparatus is a vertical autoclave into which the pelts or hides are introduced on an appropriate suspension device. After the end of tanning the pelts/hides are either dried thermally in the autoclave or else the suspension device is removed together with the pelts or hides and drying is carried out in a separate drying cabinet. Post-greasing takes place subsequently. For this purpose, the fatliquor formulation is charged to an initial-charge autoclave. Carbon dioxide is passed through the initial-charge autoclave. The pressure and temperature are set such that the fat is dissolved in the carbon dioxide. Typical conditions are from 100 bar to 350 bar and from 40 to 80° C. The fat-laden carbon dioxide is introduced into the autoclave, which has been charged with pelts. In this autoclave the pressure and temperature are set such that the solubility of the fats in carbon dioxide is reduced. Typical pressures and temperatures are from 40 to 200 bar and from 25 to 50° C. The fat then precipitates preferentially on the pelts or hides which are present in the autoclave and in the hide pores which have been penetrated by carbon dioxide. After the end of greasing, the pelts or hides are removed. The excess fat on the surface and on the hairs (in the case of pelts) is worked in during the subsequent drumming process or removed in cleaning processes. Degreasing by means of CHC, HC or other fat-dissolving agents is not necessary.

Yet another exemplary embodiment of the process according to the invention is characterized by the leading of the pelts and of the tanning solution in countercurrent. The principle of the process is explained with reference to a unit consisting of two autoclaves. However, the process can also be employed in a unit having only one autoclave and corresponding storage vessels, or else in a multi-autoclave unit. Fresh, soaked pelts are placed in a first autoclave 1. In a second autoclave 2, partially tanned pelts are treated with fresh tanning solution. During this treatment, the concentration of active substance in the tanning solution is reduced, the partially tanned pelts or hides are tanned completely, and are removed after the autoclave 2 has been let down. The partially spent tanning solution withdrawn from the autoclave 2 is added to the fresh pelts or hides in the autoclave 1, where these pelts or hides are part-tanned, while at the same time the concentration of active substance in the tanning solution is reduced further. The resulting exhausted tanning solution is obtained as waste water. For complete tanning of the pelts or hides, fresh tanning solution is then added to the autoclave 1. In the intervening period, the autoclave 2 is charged with fresh pelts or hides which are then part-tanned using the partially spent tanning solution from the autoclave 1. The advantage of this procedure is that the concentration of tanning chemicals in the waste water is very greatly reduced. This is particularly important since the tanning chemicals are the most difficult waste substances to degrade in the processing of pelts and hides.

The text below indicates a number of experimental examples of the process according to the invention.

EXAMPLE 1

A mink pelt treated in a soak bath (7 g/l surfactants, 50 g/l salt, 25° C., 12 h) and spun was placed in a high-pressure autoclave (V=200 ml, $P_{max}$=1000 bar, $T_{max}$=500° C.) and treated for 1 hour with liquid carbon dioxide at 200 bar and 25° C with the aim of opening up the skin and thus preparing it for tanning. The autoclave was let down (10 minutes) and opened and the pelt was removed. The pelt was then washed (10 g/l surfactants, 40 g/l salt, 30° C., 2 h) and opened up (10 g/l organic acid, 60 g/l salt, pH 3.8 to 4, 30° C., 24 h). The pelt (female mink) was then dipped briefly (2 minutes) in tanning solution (40 g/l aluminum salt, Na acetate, pH 3.8 to 4.5, 3 g/l synthetic surfactants, 15 g/l fatliquors). The ratio between liquid absorbed and pelt weight (which corresponds to the liquor ratio) was determined by weighing. The ratio was in this case 1.3:1. The pelt prepared in this way was placed in an autoclave having a volume of 600 ml and was treated for 3 hours with carbon dioxide at 200 bar and 40° C. After letting down the autoclave, the pelt was removed and subjected to conventional further processing. The pelt was classified as very good in terms of the customary quality criteria. The tanning process, which usually lasts from 12 to 14 hours and requires liquor ratios from 6 to 12:1, was therefore replaced by a three-hour treatment under a carbon dioxide atmosphere. In addition to the considerable time saving, the treatment with carbon dioxide, when the dipping technique is employed, reduces the amount of tanning solution required by from 78 to 92%.

EXAMPLE 2

3 fox pelts, 5 mink pelts (male) and 1 muskrat pelt were placed in an unordered pile in an 8 liter autoclave. The total volume of the pelts was 5.9 liters. Above the pelts there was an empty space of 10 cm. The pelts had been soaked (see Example 1) and pretreated for just a few minutes in an acid opening-up bath (see Example 1). Installed at the bottom end of the autoclave was a sinter plate (d=139.8 mm, H=3 mm, 200 $\mu$m) in order to prevent the entrainment of hairs. Tanning solution (4 liters, composition see Example 1) was introduced until the pelts were completely covered. The autoclave was closed and $CO_2$ was pumped in up to 200 bar. After the first pressure buildup the tanning solution was circulated using a liquid pump having a capacity of about 6 liters/h and was sprinkled by way of a distributor at the head of the autoclave. During the runup process (about 30 minutes) carbon dioxide dissolved in the liquid. In order to compensate the pressure loss which this entailed, it was necessary to pump in further $CO_2$ at intervals of 10 minutes. Subsequently, tanning was carried out under constant pressure for 2.5 h. The total contact time of the pelts with tanning solution was 3 h. After the end of tanning, the tanning solution was drained off at the bottom.

An initial test of the pelts showed that some pelts were tanned completely while others had a few relatively small untanned areas. This is attributed to inadequate distribution of liquid and to piling problems (e.g. twisted pelts). The pelts were subjected to conventional further processing. The quality of the fully tanned pelts was classified as very good, whereas the pelts having obviously untanned areas were discarded.

EXAMPLE 3

The experiment described in Example 2 was repeated under identical conditions. However, the pelts were introduced into the autoclave in a form in which they were fixed on a suspension device, in such a way that the head and tail end hung on a ring attached to the autoclave lid and the pelts therefore had a U shape. Above the ring there remained a gas space of 10 cm in height. The autoclave was filled with tanning solution to a point such that the pelts were completely covered. The total tanning time was likewise 3 hours.

Afterwards, the pelts were completely tanned. Following conventional further treatment, their quality was classified as very good.

EXAMPLE 4

The experiment described in Example 3 was repeated in a roller autoclave. The autoclave was placed on a motorized roller device and during the experiment was moved at a rate of circulation of 2 revolutions per minute. As a result of this, the 9 pelts (see Example 2) introduced into the autoclave were brought into intensive contact with the tanning solution. In analogy to Example 3, the pelt quality obtained was classified as very good.

EXAMPLE 5

A multistage tanning was conducted in two autoclaves connected in series. The experiment shows that this procedure achieves a considerable reduction in the concentration of tanning chemicals in the waste water. The pelts employed had been soaked (see Example 1) and washed (see Example 1). No opening up was carried out.

In the autoclave 1, 9 mink pelts (7 female, 2 male), 9 muskrat pelts and 2 bassarisks were treated with fresh tanning solution (composition see Example 2). The pelts were introduced on the suspension device described in Example 3. The carbon dioxide pressure was 50 bar. The tanning solution was sprinkled over the pelts for 3 hours using a circulating pump having a capacity of about 6 liters/h. The temperature was 40° C. The tanning solution was subsequently transferred to the autoclave 2, into which a total of 18 muskrat pelts had been introduced. The tanned pelts from autoclave 1 were removed and subjected to conventional further processing. The pelt quality was classified as very good. 1 mink pelt (male) was analyzed. The analytical values were as follows:

pH: 4.2

Difference number: 0.4

$Al_2O_3$ content: 1.3%

Dichloromethane extractables: 6.7% (=fat content)

Puncture resistance without hair: 29.2 N/mm

Tearing propagation resistance without hair: 7.4 N/mm

Tensile strength without hair: 33.1 N/mm$^2$

Shrinkage temperature in distilled water: 54° C.

Shrinkage temperature in salt solution: 78° C.

In autoclave 2, the partially spent tanning solution was sprinkled over the pelts under a carbon dioxide pressure of 50 bar and at a temperature of 40° C. for 3 hours. After the end of the experiment the tanning solution was drained off. The tanning solution was virtually water-clear. The residual aluminum content was about 50 mg/l, i.e. the tanning solution was almost completely exhausted.

Then fresh tanning solution was pumped into the autoclave 2 and was sprinkled over the partially tanned pelts under a carbon dioxide pressure of 50 bar and at a temperature of 40° C. for 1.5 hours. After the end of the experiment the partially spent tanning solution was drained off and was available for a further tanning step in autoclave 1. The pelts remaining in the autoclave 2, which were now fully tanned, were removed and subjected to conventional (see Example 1) further processing. The quality was classified as being good to very good.

EXAMPLE 6

Two soaked (soak bath see Example 1) mink pelts (male) were treated in a roller autoclave at 100 bar $CO_2$ pressure for 2 hours with addition of an increased amount of fatliquor and an emulsifier (fatliquor+emulsifier: 200 g/l). The roller autoclave was filled with enough solution to just cover the pelts. The temperature was 35° C. After the end of the experiment the pelts were removed and first of all were freed mechanically from excess fat. The pelts were subsequently dried, cleared with sawdust and drummed. After drumming, the pelts were cut thin and finally drummed in cornflour. The quality of the pelts was classified in accordance with the customary criteria as being good to very good. With this embodiment of the process, therefore, it is possible to save as well on process steps required after tanning. Solvent wastes from degreasing can in this way be avoided or reduced.

We claim:

1. A process for finishing animal hides or pelts, comprising:

soaking the animal hides or pelts in a soak solution; and after soaking, treating the hides or pelts with a tanning solution in which carbon dioxide has been dissolved under pressure.

2. The process according to claim 1, including washing the hides or pelts before the treating step.

3. The process according to claim 1, wherein the tanning solution additionally comprises fats which are emulsified in an aqueous phase.

4. The process according to claim 1, wherein after the treating step, the animal hides or pelts are dried and then treated with fat which is dissolved in pressurized carbon dioxide.

5. The process according to claim 1, including conducting the treating in a countercurrent manner, wherein fully tanned hides or pelts are treated with fresh tanning solution while untanned hides or pelts are treated with partially spent tanning solution.

6. The process according to claim 1, including dissolving carbon dioxide in the soak solution under pressure.

7. The process according to claim 1, wherein the carbon dioxide pressure is 5 to 300 bar.

8. The process according to claim 1, wherein the solution in which carbon dioxide has been dissolved under pressure has a temperature in the range from 0 to 60° C.

9. The process according to claim 1, wherein a mass ratio between the soak solution and the animal hides or pelts is in the range from 1:1 to 4:1.

10. The process according to claim 1, including conducting the treatment under carbon dioxide pressure for a period of about 30 minutes to about 3 hours.

11. The process according to claim 2, wherein after the treating step, the animal hides or pelts are dried and then treated with fat which is dissolved in pressurized carbon dioxide.

12. The process according to claim 2, including conducting the treating in a countercurrent manner, wherein fully tanned hides or pelts are treated with fresh tanning solution while untanned hides or pelts are treated with partially spent tanning solution.

13. The process according to claim 4, including conducting the treating in a countercurrent manner, wherein fully tanned hides or pelts are treated with fresh tanning solution while untanned hides or pelts are treated with partially spent tanning solution.

14. The process according to claim 2, including dissolving carbon dioxide in the soak solution under pressure.

15. The process according to claim 4, including dissolving carbon dioxide in the soak solution under pressure.

16. The process according to claim 5, including dissolving carbon dioxide in the soak solution under pressure.

17. The process according to claim 1, wherein the carbon dioxide pressure is 15 to 50 bar.

18. The process according to claim 4, including conducting the treatment under carbon dioxide pressure for a period of about 30 minutes to about 3 hours.

19. The process according to claim 6, including conducting the treatment under carbon dioxide pressure for a period of about 30 minutes to about 3 hours.

* * * * *